United States Patent [19]

Hoff, Jr.

[11] Patent Number: 4,771,671

[45] Date of Patent: Sep. 20, 1988

[54] ENTERTAINMENT AND CREATIVE EXPRESSION DEVICE FOR EASILY PLAYING ALONG TO BACKGROUND MUSIC

[75] Inventor: Marcian E. Hoff, Jr., Sunnyvale, Calif.

[73] Assignee: Breakaway Technologies, Inc., San Francisco, Calif.

[21] Appl. No.: 1,813

[22] Filed: Jan. 8, 1987

[51] Int. Cl.[4] ..... G10G 1/00; G10H 7/00

[52] U.S. Cl. ..... 84/1.01; 84/1.28; 84/453

[58] Field of Search ..... 84/1.01, 1.28, 453, 84/454, 477 R, DIG. 9, DIG. 18, DIG. 29; 381/49-51; 324/78 R, 78 D, 79 R, 79 D

[56] References Cited

U.S. PATENT DOCUMENTS

| | | | |
|---|---|---|---|
| 3,539,701 | 11/1970 | Milde | 84/1.28 |
| 3,634,596 | 1/1972 | Rupert | 84/1.28 |
| 3,999,456 | 12/1976 | Tsunoo et al. | 84/1.01 |
| 4,313,361 | 2/1982 | Deutsch | 84/1.01 |
| 4,377,961 | 3/1983 | Bode | 84/1.01 |
| 4,441,399 | 4/1984 | Wiggins et al. | 381/49 X |
| 4,463,650 | 8/1984 | Rupert | 84/1.01 X |
| 4,633,748 | 1/1987 | Takashima et al. | 84/1.01 |

FOREIGN PATENT DOCUMENTS 0142935 5/1985 European Pat. Off. .

*Primary Examiner*—Stanley J. Witkowski

*Attorney, Agent, or Firm*—Philip M. Shaw, Jr.

[57] ABSTRACT

An electronic entertainment device which allows an untrained vocalist or instrumentalist to easily synthesize an instrumental lead, and optionally, one or more harmonies, simultaneous with the lead, playing along with predefined background musical sequences. While the background parts to a song are being played by the device, or any outside musical player, the user plays the melody, or "lead", by humming, singing, whistling, or operating any tone-producing device, such as a musical instrument, into the device. The device then identifies the pitch, compares it with a table of allowable pitches, as dictated by predefined data associated with the background music, chooses an appropriate output tone, and drives a music synthesizer to play the chosen instrument at the determined pitch, in accordance with the allowable pitches. The note which is produced by the device is one which sounds pleasing in the context of the musical background. The device facilitates an active involvement in music expression without a need for well developed skills as a vocalist or instrumentalist.

15 Claims, 4 Drawing Sheets

ENTERTAINMENT AND CREATIVE EXPRESSION DEVICE FOR EASILY PLAYING ALONG TO BACKGROUND MUSIC

BACKGROUND

1. Field of the Invention

This invention relates to electronic musical instruments which are simple and fun to use and more particularly to a voice controlled musical instrument.

2. Description of the Prior Art

Musical instruments have traditionally been difficult to play, thus requiring a significant investment of time and, in some cases money, to learn the basic operating skills of that instrument. In addition to frequent and often arduous practice sessions, music lessons would typically be required, teaching the mechanical skills to achieve the proper musical expression associated with that instrument, such as pitch, loudness, and timbre. In addition, a musical language would be taught so that the user would be able to operate the instrument to play previously written songs.

The evolution of musical instruments has been relatively slow, with few new musical instrument products taking hold over the past several hundred years. The introduction of electronics-related technology, however, has had a significant impact on musical instrument product development. The music synthesizer, for example, together with the piano keyboard interface/controller, has vastly expanded the number and variety of instrument sounds which can be produced by a person who has learned to play a single instrument—that of piano or keyboards. The requirement remained, however, that for someone to operate a synthesizer, that person would have to learn at least some of the fundamentals of music expression associated with playing a piano.

Therefore, for those people who wanted to be able to express themselves musically, but had not learned to play an instrument, or wanted to be able to make many instrument sounds without learning how to play each instrument, there was still a significant time investment required to learn the skill, with no assurance that they could ever reach a level of proficiency acceptable to them.

A variety of methods have been proposed to use the human voice to control a synthesizer, thus taking advantage of the singular musical expression mechanism which most people have virtually anyone who can speak has the ability to change musically expressive parameters such as pitch and loudness. One such method is described in U.S. Pat. No. 4,463,650, by Robert Rupert, issued Aug. 7, 1984 incorporated herein by reference. In the Rupert device, real instrumental notes are contained in a memory with the system responsive to the stimuli of, what he refers to as, "mouth music" to create playable musical instruments that will respond to the mouth music stimuli in real time.

The difficulty in practice with using the voice as a controller of a musical synthesizer is that some people have little real or perceived ability to reach pitches in a manner accurate enough to believe they sound good. Even trained vocalists have vocal characteristics such as frequency and interval which are unstable and to some degree inaccurate. Such frequency error or instability goes virtually unnoticed by any one who hears the vocal tone directly. However, the frequency error or instability of the output tone signal can be distinctly perceived by any one when he hears a vocal tone processed by a conventional voice-controlled music synthesizer, as that suggested by Rupert. As a result, there is some segment of the population which may not perceive the voice controlled music synthesizer, alone, as a viable route to personal musical expression and/or entertainment.

One such solution is described in European Pat. No. 142,935, by Ishikawa, Sakata, and Obara, entitled "Voice Recognition Interval Scoring System", dated May 29, 1985. In this patent, Ishikawa et. al., recognize the inaccuracies of the singing voice and "contemplates providing correcting means for easily correcting interval data scored and to correct the interval in a correcting mode by shifting cursors at portions to be corrected". In a similar attempt to deal with the vocal inaccuracies, a device described in U.S. Pat. No. 3,999,456 by Masahiko Tsunoo et al, issued Dec. 28, 1976, utilizes a voice keying system for a voice-controlled musical instrument which limits the output tone to a musical scale. The difficulty in employing either the Ishikawa or the Tsunoo devices for useful purposes is that most untrained musicians will not know which scales are appropriate for different songs and applications. The device may even be a detractor from the unimproved voice-controlled music synthesizer, due to the frustration of the user not being able to reach certain notes he desires to play.

In a related area, the concept of "music-minus-one" is the use of a predefined usually prerecorded musical background to supply contextual music around which a musician/user sings or plays an instrument, usually the lead part. This concept allows the user to make fuller sounding music, by playing a key part, but having the other parts played by other musicians. Benefits to such an experience include greater entertainment value, practice value and an outlet for creative expression.

SUMMARY DESCRIPTION OF THE INVENTION

The invention disclosed herein is an enhancement on the music minus-one concept, providing a degree of intelligence to the musical instrument playing the lead the voice-controlled music synthesizer, in this case so as not to produce a note which sounds dissonant or discordant relative to the background music. In addition, this invention is an improvement on the voice-controlled music synthesizer, by employing correction, but in such a way that the device can be used and enjoyed by all parties. Rather than correcting the interval in an arbitrary manner, as suggested in the Tsunoo and Ishikawa patents, this device adjusts the output of the music synthesizer to one which necessarily sounds good, to the average listener, relative to predefined background music. The key advantage of this invention is that it allows any person with speaking ability to be able to express himself/herself musically and sound good doing it, with virtually no training. Such a device can provide useful entertainment and/or creative expression value to a large number of people. In addition, it can help people learn to improvise and play music "by ear".

The entertainment and creative expression device disclosed in this application is comprised of pitch extraction means for determining pitch from a sound source, a means for storing and transmitting background music information, such as note pitches and intervals and background instruments selected, a means for storing and transmitting relevant allowable, or pleasant sounding, lead tone and harmony tone data associated with the background music, a means for using the associated filter data to translate the tone determined from the pitch extraction means raw frequency or pitch data extracted from the source tone to a tone determined to be allowable as defined in the associated filter data, music synthesizer means for musically synthesizing the output tones from the output tone data, and a means for synthesizing, transmitting, or reproducing the background music from the background music data.

Other objects, features and advantages will be made clear from the following description of embodiments thereof considered together with the accompanying drawings.

DETAILED DESCRIPTION OF THE PREFERRED EMBODIMENT

Figure 1:
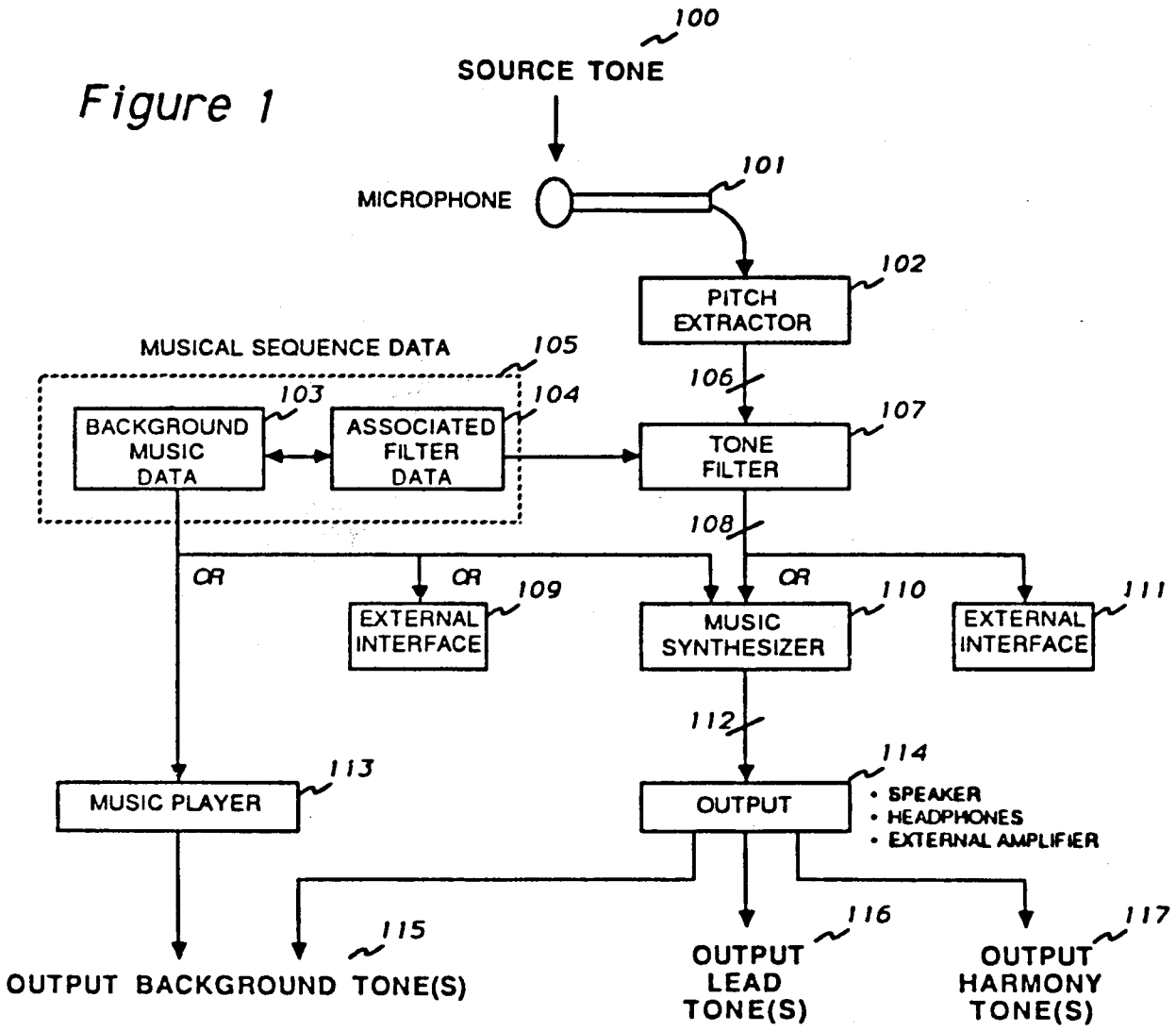
FIG. 1 is a schematic block diagram of an embodiment of the voice controlled entertainment device for easily playing along to background music, made in accordance with this invention.

Referring to FIG. 1, a Source Tone 100 is received by the entertainment and creative expression device disclosed herein. The sound source can be single or multiple tones produced by a human voice singing voicing or not voicing words, humming, whistling, talking, using any single syllable such as "doo, doo, doo" or "lah, lah, lah" at varied pitches, or multiple syllables at varied pitches, or any audio apparatus which can produce tones, such as acoustic or electric or electronic musical instruments, for example, recorders, whistles, trumpets, electric guitars and the like. Each "tone" contains a fundamental frequency identifying a pitch together with a start time and duration. A sequence of pitch, start time and duration data defines a "tone sequence", "tune", "musical sequence", or "song" these terms are used interchangeably.

The introduction of the tone into the device can be either through a built-in microphone 101, external microphone, or specialized audio sensing device, such as a guitar "pick-up". For purposes of this application, the term "microphone" represents all such devices. The source tones which are introduced into the device through the microphone 101 are the basis for controlling musical tones which emerge from the device which will sound pleasing relative to predefined background music.

The input signal which is detected by the microphone 101 is analyzed by the pitch extractor 102 to determine at least the fundamental frequency or pitch of the source tone. A variety of approaches exist to detect fundamental frequencies from analog signals. One such approach is described in U.S. Pat. No. 4,202,237, dated May 13, 1980, by Bjarne C. Hakansson. Hakansson's invention extracts a fundamental frequency from signals coming from played musical instruments. Another such approach is described in U.S. Pat. No. 4,457,203, dated July 3, 1984, by Schoenberg et al. Schoenberg's patent describes a device which can automatically detect and display the fundamental frequency from sound sources with continuous frequency ranges such as the human voice.

The device's input or source tone 100, associated output tone, and associated tone-in-process at any stage within the device, are referred to herein as the "lead". The lead can be any tone or sequence of tones which the user desires, including the user's idea of a melody associated with the respective background music, the actual melody associated with the background music, a harmony associated with the background music, or a sequence totally unassociated with the intent of the author of the musical piece comprising the background music. The output tone associated with the lead is referred to as the "output lead tone" 116.

In addition to being able to generate an output lead tone 116 from the respective source tone 100, the invention optionally generates another output tone associated with the output lead tone 116 and the output background tones 115—analog tones of the background music called, in this application, an output harmony tone or tones 117. The output harmony tone is an output tone which appears to "follow" or "harmonize" with the lead tone, in such a way as to sound pleasant relative to the output background tones 115.

The memory means 105—"musical sequence data" or "song data" for the background music, along with which the user is playing the lead, contains the background music data 103 and the associated filter data 104. The musical sequence data is a necessary component of he invention. The background music data 103 can be any sequence of single or multiple notes which creates a context of musical information along with which the device's user can play a lead. The tone sequences can form recognizable songs, or parts of songs, generic patterns of tone sequences associated with certain musical styles, such as rock, folk, blues, jazz, reggae, country, and classical, or any other sequence or sequences of tones. The sound types used to play these note sequences can be pitched or nonpitched, having timbres or sound personalities associated with traditional musical instruments, electrical musical instruments, electronic or synthesized musical instruments, known or unknown sound effects, or any other type or types of sounds. For purposes of this specification, these tone sequences are referred to as "background music" or "background music data".

The media which is used to store the musical sequence data in 105 can be read-only-memory ROM circuits, or related circuits, such as EPROMs, EEROMs, and PROMs; optical storage media, such as videodiscs, compact discs CD ROMs, CD-I discs, or other, and film; bar-code on paper or other hard media; magnetic media such as floppy disks of any size, hard disks, magnetic tape; audio tape cassette or otherwise; phonograph records; or any other media which can store digital or analog song data or songs, or a hybrid of analog and digital song data or songs; or any combination of media above. The medium or media can be local, or resident in the embodiment of the device, or remote, or separately housed from the embodiment of the device.

The associated filter data 104 must necessarily be used by the device, either directly read from the storage media, or after any processing inside, or outside the device, to establish relevant allowable output tones from the source tones.

Figure 2:
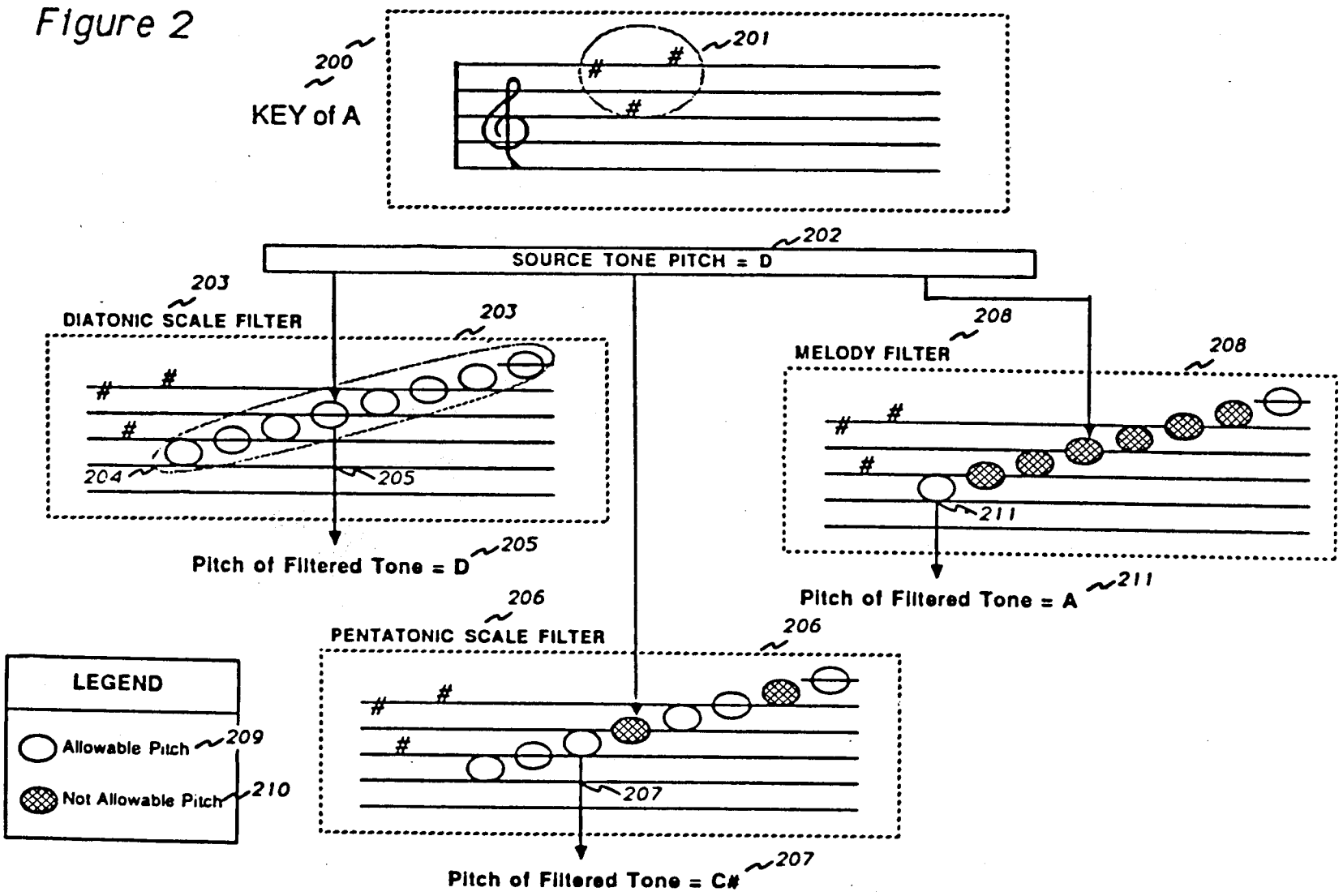
FIG. 2 illustrates three examples of filter schema "filter tables" of varying degrees of correction.
Figure 3:
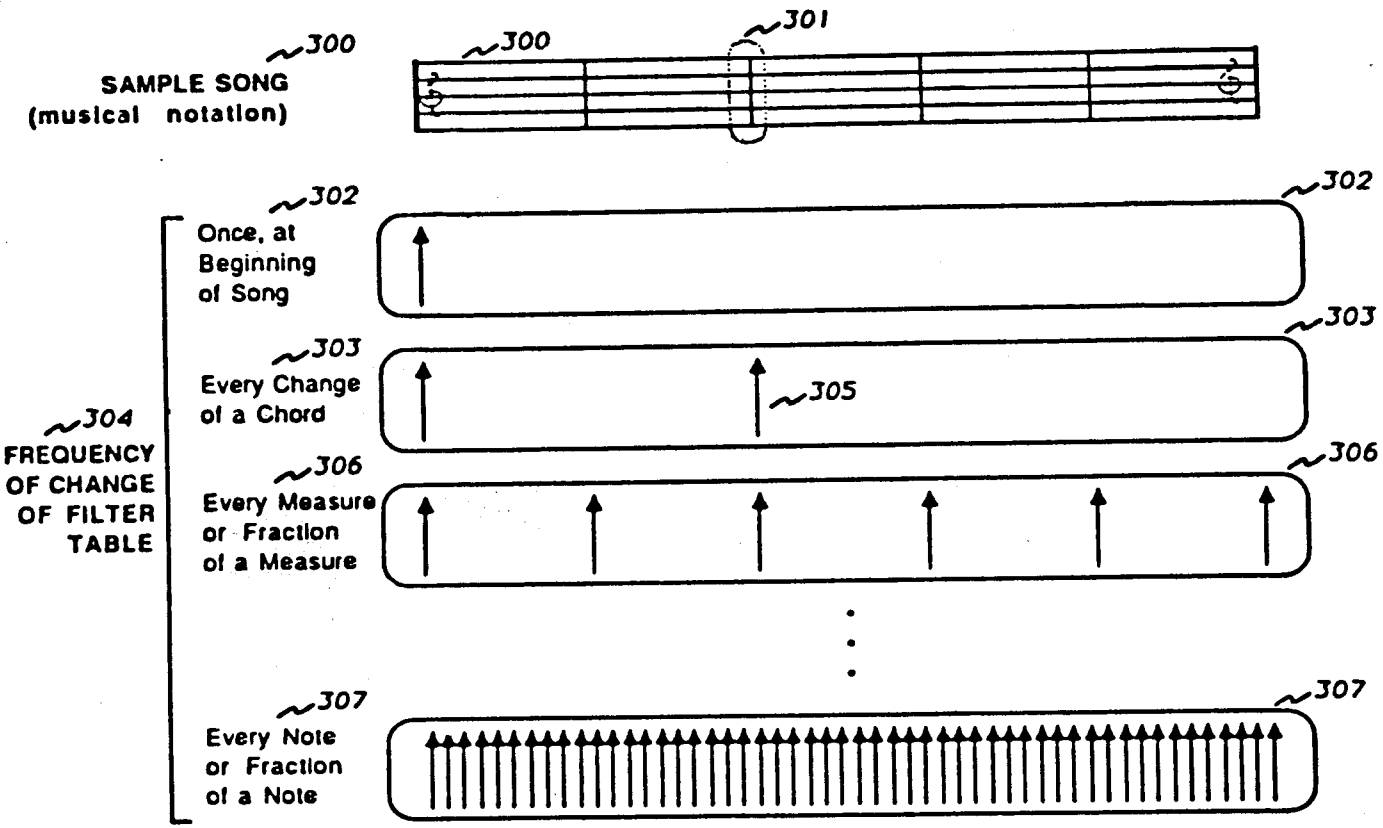
FIG. 3 illustrates some of the options regarding changing of the filter schema or tables during or between musical sequences songs.

The musical sequence data storage means 105 communicates the associated filter data 104 to a tone filter 107 which accepts at least the raw frequency or pitch data 106 from the pitch extractor 102 and translates the raw frequency or pitch data 106 and any other relevant tone data to relevant allowable output tone data 108 in accordance with the associated filter data 104 predefined for the background musical sequence 103 being played. The allowable output tone data will include, at the minimum, data regarding the output lead tone 116, and may optionally include data regarding the output harmony tone or tones 117. The output harmony data can be data describing one, two, or more tones generated simultaneously. Both output lead data and output harmony data is determined by the tone filter 107 which utilizes the filter data 104 associated with the background musical data 103 to analyze and process the raw frequency or pitch data 108 from the pitch extractor 102. Examples of implementation means for translating the raw frequency or pitch information 106 into output tone data 108 are illustrated in FIG. 2 and FIG. 3, and described in detail later in this specification.

The output tone data 108, at least the output lead tone data, and optionally the output harmony tone data is then transmitted to a music synthesizer and converted to analog musical output tones 112 synthesizing musical instruments of known timbre, timbre which is similar to known timbres, or unknown timbre, or sound effects, in accordance with the defined output tone data. The user may either be allowed to define which timbre to choose for the output tone or tones, or the musical sequence data 105 will specify the appropriate timbre or timbres, or the device will be implemented so as not to offer a choice to the user as to timbre for the output tone or tones.

One implementation of the invention has the output tone data transmitted to an external interface 111 which allows the information to be used to drive an external music synthesizer, and/or to be transmitted to an external sequencer or recording device, computer, printer, another voice-controlled entertainment and creative expression device such as that disclosed herein, or any other external device for accepting and/or processing the output tone data. The interface may be an accepted standard, such as RS-232 or MIDI Musical Instrument Digital Interface, or any other communicating or interface means.

Concurrent with the transmission of the output tone data 108 to the music synthesizer 110, the background musical data 103 is transmitted to a music synthesizer (either the same 110 as that used to generate the analog musical output tones 112 or a different one) and converted to analog musical output tones 112 synthesizing musical instruments of known timbre, timbre which is similar to known timbres, or unknown timbre, or sound effects, in accordance with the defined background music data, or transmitted to an external interface 109 similar to 111, or transmitted to another musical player, such as a phonograph, radio, stereo, tape player, compact disc player, videodisc player, video tape player or any other sound generating device. The user may either be allowed to define which timbres to choose for the output tones or the musical sequence data 105 will choose the appropriate timbres, or, in some low cost embodiments the device can be implemented so as not to have a choice as to timbre.

The analog musical output tones are transmitted to the user through output means 105 such as speaker, headphones, display, external amplifier and associated speaker, or any other audio transmission means.

FIG. 2 illustrates three examples of filter schema 107 employed at any discrete point in time during the operation of the entertainment and creative expression device disclosed herein. For these examples, the source tone introduced into the entertainment and creative expression device is a whole note which has a pitch 202 squarely on a D note of any octave, and therefore, the tone's raw pitch 106 detected by the pitch extractor 102 is that of a D. The examples show the use of "the key of A" 200, as represented by three sharps 201 as illustrated on the musical staffs in FIG. 2, as the filter's reference scale, and illustrates three degrees of correction or conversely three degrees of freedom which can be employed using the scale in the key of A. These examples are the "diatonic scale filter" 203, the "pentatonic scale filter" 206, and the "melody filter" 208, in order of decreasing degrees of freedom, or increasing degrees of correction, respectively.

In the diatonic scale filter example 203, the allowable tones are the seven notes 204 at any octave of the A major scale, or the notes A, B, C♯, D, E, F♯, and G♯ illustrated in FIG. 2 by showing the whole notes in the scale as open or clear in the center 209. Not allowed would be all tones with pitches between notes in the A major scale. Since the pitch of the source tone is D 202, the output lead tone data will include the pitch designation of D 205, implementing no pitch correction on the source tone.

In the pentatonic scale filter example 206, the allowable tones are the five illustrated notes A, B, C♯, E, and F♯ open whole notes 209 on the staff in 206. The tones in the scale which are not allowed are D and G♯ closed whole notes 210 on the staff in 206. Also not allowed are all tones with pitches between notes in the A major scale. Since the pitch of the source tone in this example is D, the pitch will be corrected by the tone filter to become the closest tone in the allowable tone set, which in this case is C♯ 207.

In the melody filter 208 example, the allowable tones are limited to the single note at all octaves which is designated as the singular lead tone intended for that point in the musical sequence, wherein named the melody tone. In this example, the filter schema and musical sequence data define A 211 to be the allowable melody tone. Since the pitch of the source tone in this example is D, that pitch will be corrected by the tone filter, in this example to the nearest A note 211 which is three scale steps down from D.

FIG. 3 illustrates one of the key dynamic characteristics of the tone filter 107—that of changing the filter schema within or between musical sequences. FIG. 3 illustrates some of the options for changing these filter schema termed "filter tables" in the figure. The musical sequence represented by the musical staff or "sample song"—300 is displayed at the top of the figure and four options for the frequency of change of the filter tables 304 are positioned below the musical staff purposely aligned to show various possible frequencies for the change of filter tables. A change in the filter table is represented by a vertical arrow 305 pointing upward, at the relevant point in the musical sequence, as represented by the musical staff.

The filter data associated with the musical sequence can be set or changed once 302, at the beginning of the musical sequence song and remain the same throughout the song, or it may change every time there is a change in a chord 303, or it may change every measure 301 or fraction of a measure 306, or it may change every note or fraction of a note 307. These frequencies of filter table changes 302, 303, 306, 307 are some of the many options which can be employed to change the filter schema or tables. These examples represent differing degrees of sophistication of the filter schema, and thus differing costs, as well as memory requirements for the filter data 104 associated with the musical background data. The more frequent the change of filter tables, the more development time and thus associated cost required to "score" or annotated each musical sequence, and the more memory required to store the filter data.

Figure 4:
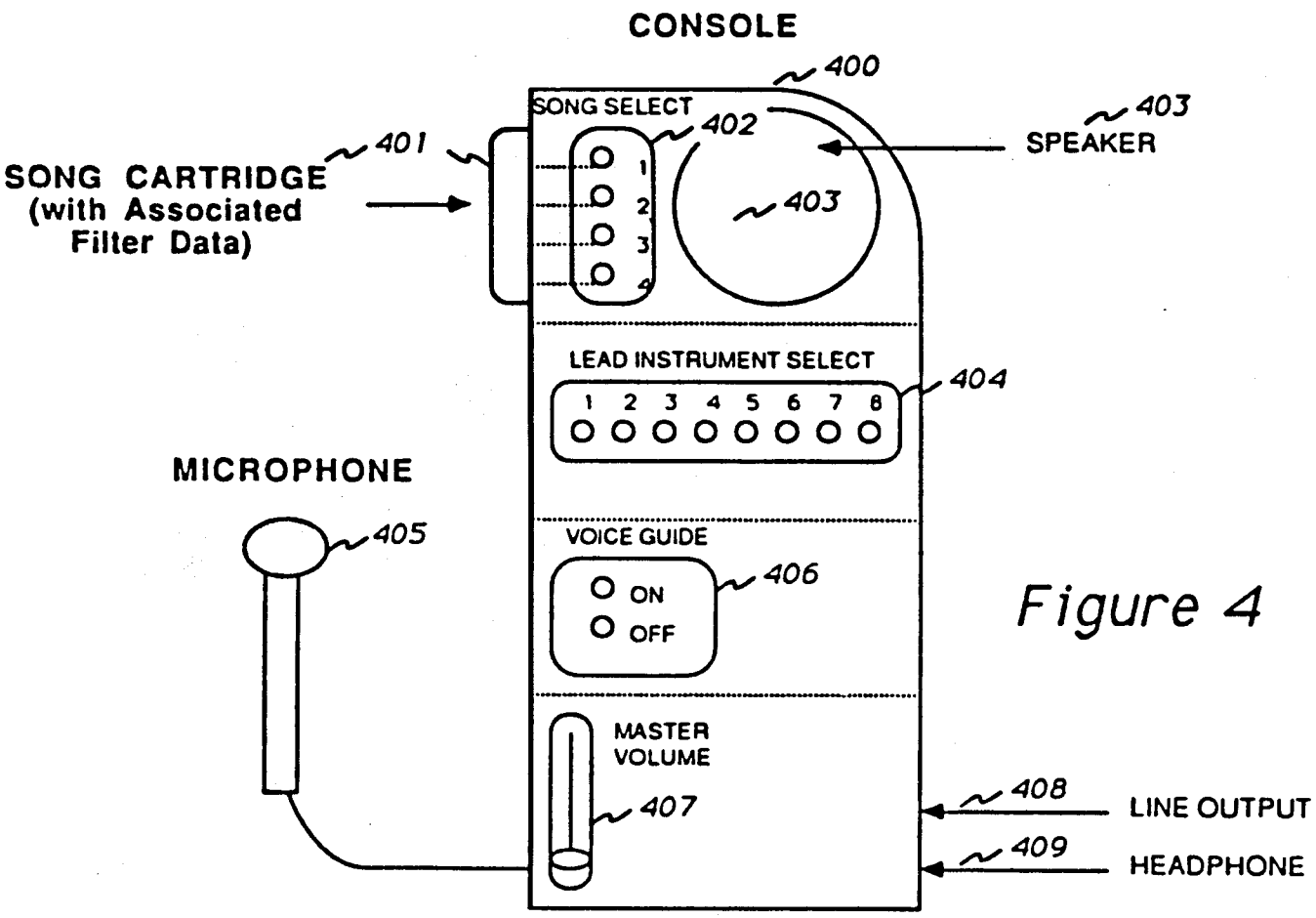
FIG. 4 pictorially illustrates one of the preferred embodiments of the invention.

FIG. 4 is an illustration of an example of one of the preferred embodiments of the invention. This embodiment includes a console 400 with built-in speaker 403, a microphone or pickup 405, one or more musical sequence or song ROM cartridge 401 with associated filter data, and optional connectors for outside amplification 408 or headphones 409. The cartridge for the desired musical sequence is inserted into the console. On the console, the user is offered the control 402 over which specific musical sequence to play as background if the cartridge contains more that one such musical sequence. This configuration shows four choices 402 but the embodiment could include any number of choices of songs, depending on what is determined to be economic to offer in the system's largest available or planned cartridge. Also on the console, the user is offered the control 404 over which lead instruments are used to sound the output lead tones 116. In addition, the console has master volume control 407 and a "voice guide" selection 406, the latter which enables "on" or disables "off" the tone filter 107. The purpose of this control would be to let singers choose to implement no correction to at least the pitch in the source tone. Optional, but not shown in this configuration, is a set of user controls to activate and manipulate a harmony feature as described in this application.

Although the present invention has been shown and described with respect to preferred embodiments, various changes and modifications which are obvious to a person skilled in the art ow which the invention pertains are deemed to lie within the spirit and scope of the invention.

What I claim as my invention is:

1. An entertainment device for enabling a user to easily play along with background music comprising:

first memory means for storing and transmitting background music information, said information consisting of a series of information units, each of said information units representing at least pitch and time values, second memory means, connected to said first memory means, for defining at least a set of allowable pitch values for each of said information units in said first memory means, input means for accepting an audio signal, pitch extracting means, associated with said input means, for extracting at least the fundamental pitch of the audio input signal, filtering means associated with said pitch extracting means and said second memory means, for converting said pitch extracted from said audio input signal to one of said allowable pitch values, and means for transmitting a signal representing said converted pitch value.

2. An entertainment device as set forth in claim 1, wherein said allowable pitches stored in said second memory means represent pitches which harmonize with the pitch values in corresponding information units in said first memory means.

3. An entertainment device as set forth in claims 1 or 2, further comprising a musical sound generator, said generator having as input said converted pitch value.

4. An entertainment device as set forth in claims 1 or 2, wherein said signal representing the converted pitch values is transmitted through any external communicating means.

5. An entertainment device as set forth in claim 4, wherein the external communicating means is compatible with the RS-232 standard.

6. An entertainment device as set forth in claim 4, wherein the external communicating means is a MIDI (Musical Instrument Digital Interface).

7. An entertainment device as set forth in claims 1, 2, 3 or 4, further comprising a musical sound generator for reproducing the background musical information.

8. An entertainment device as set forth in claims 1, 2, 3 or 4, further comprising an independent music playing device for reproducing the background musical information.

9. An entertainment device as set forth in claim 8, wherein the independent music playing device reproduces audio signals from prerecorded media.

10. An entertainment device as set forth in claim 8, wherein the independent music playing device comprises a microprocessor together with a prerecorded memory device.

11. An entertainment device as set forth in claim 1 wherein the first memory means stores background music information on the tone interval, including the starting time, stopping time, or duration of the tone, and the filtering means includes means for mapping the input tone interval to an allowable output tone interval.

12. An entertainment device as set forth in claim 1 wherein the filtering means generates a plurality of output tones from each input tone using the data associated with the background music and supplied by the first memory means to define an allowable relationship between each of the plurality of output tones.

13. An entertainment device as set forth in claims 1 or 2, further comprising user controls for allowing the user to choose between alternative musical sequences.

14. An entertainment device as set forth in claim 1, further comprising user controls for allowing the user to choose between alternative timbres personalities for the output tones.

15. An entertainment device as set forth in claim 1, wherein the embodiment includes a visual display of the lead tone note.

* * * * *